US005345153A

United States Patent [19]

Vaught

[11] Patent Number: 5,345,153

[45] Date of Patent: Sep. 6, 1994

[54] ORNAMENTAL CLOSURE

[76] Inventor: Michael Vaught, Oscaleta Rd., S. Salem, N.Y. 10590

[21] Appl. No.: 31,266

[22] Filed: Mar. 15, 1993

[51] Int. Cl.[5] ..... F16M 11/00; A47G 35/00

[52] U.S. Cl. ..... 318/4; 318/102; 248/915; 362/806; 428/542.2; 446/242

[58] Field of Search ..... 318/3, 4, 5, 7, 34, 318/53, 101, 102, 103; 248/915; 362/124, 125, 806, 808; 428/7, 13, 14, 18, 542.2; 446/4, 5, 82, 83, 175, 236, 268, 279, 280, 281, 297, 330, 331, 360, 437, 242

[56] References Cited

U.S. PATENT DOCUMENTS

D. 252,688 8/1979 Ahn .
D. 258,450 3/1981 Ahn .
D. 259,120 5/1981 Ahn .
D. 265,836 8/1982 Ahn .
D. 269,970 8/1983 Cohen .
D. 277,474 2/1985 Miura .
D. 282,263 1/1986 Ahn .
D. 314,055 1/1992 Ross, Jr. et al. .
D. 318,681 7/1992 Savage .
D. 323,525 1/1992 Wong .
D. 326,676 6/1992 Wolff .
3,463,918 8/1969 Franc .
3,691,675 9/1972 Rodgers .
3,720,128 3/1973 Frank .
3,747,459 7/1973 Schmidt et al. .
3,768,175 10/1973 Hill et al. .
3,783,730 1/1974 Waters, Jr. .
4,358,792 11/1982 Domoleczny et al. ..... 358/254
4,400,736 8/1983 Weiss ..... 358/254
4,453,340 6/1984 Kozuka et al. ..... 446/437
4,459,893 7/1984 Kitamura .
4,626,224 12/1986 Benson et al. ..... 446/297
4,637,007 1/1987 Sakurai .
4,890,008 12/1989 Chu ..... 307/149
4,937,107 6/1990 Mirisch, Sr. .
4,947,722 8/1990 Lewis .
5,116,648 5/1992 Martin et al. .

*Primary Examiner*—Bentsu Ro
*Attorney, Agent, or Firm*—Nolte, Nolte and Hunter

[57] ABSTRACT

An ornamental closure which opens to a scene and includes animated scenes moved into view from within the closure. Mechanisms and electrical circuitry provide the power to operate the closure and to provide music during operation. A plurality of such closures are programmed to operate sequentially and may include hangers to secure them to the branches of a Christmas tree.

16 Claims, 4 Drawing Sheets

ORNAMENTAL CLOSURE

This invention relates broadly to electro-mechanical entertainment apparatus comprising a closure which opens to present a scene and includes mechanisms to animate the scene. Music producing elements may be provided within or externally of the closure to constitute the closure as a music box.

The invention contemplates the provision of a plurality of such closures electrically connected through a controller for sequential operation.

The invention has particular application to such closures which are decorative and the scenes presented connote a festive season; for example, Christmas.

It is contemplated within the invention to provide a Christmas tree ornament in the form of such a closure.

THE PRIOR ART

As far as is known, there is no art which provides a music box or any such entertainment apparatus which combines lifting a lid to expose an animated scene which is raised as the lid of the box is opened from a lower hidden position under the closed lid to a raised position adjacent the upper edges of the box.

There is, of course, the jack in the box and the known music boxes with figures on revolving platforms with fixed elevation; see, for example, U.S. Pat. Nos. 252,688, 258,450, 259,120 and 323.525 and having transparent covers which have no mechanical function. Also, there are the known music boxes which activate a pin roll and reeds upon lifting the lid.

BRIEF DISCUSSION OF THE INVENTION

In a particular embodiment of the invention, the closure is opened by moving a cover which, in turn, moves a platform incorporating a scene and triggers a mechanism which animates the scene, for example, by revolving the platform and scene.

The controller for multiple closure operation provides music during the opening and opened period of time for each closure and may vary the melody randomly or provide music specific to the animated scene.

A preferred embodiment of the invention provides a closure in the form of a box having a bottom comprising a container portion and a top hinged to an upper edge of the container portion. A clip or hanger or handle is provided to secure the box to a Christmas tree, if desired.

Circuitry is provided which energizes an electric motor which operates a power train to lift the lid about its hinges and at the same time lift a scene bearing platform within the box up to the level of the upper edges of the container portion. In the particular embodiment of the invention disclosed, as the platform raises, a switch acts to energize a second motor which operates a power train to animate, by rotating the platform and the scene disposed upon it.

The box is conceived as a music box, and in this respect, as the motor which lifts the lid is energized, a selected melody is played, electronically as programmed in a controller, although a pin roll and tone reed may, of course, be provided within the box according to the usual music box construction. The electronic controller is preferred and in the contemplated commercial embodiment of the invention provides eighteen Christmas carols played one at a time as each of six ornamental boxes is opened and closed, in sequence, as programmed.

DETAILED DESCRIPTION OF THE INVENTION

Figure 1:
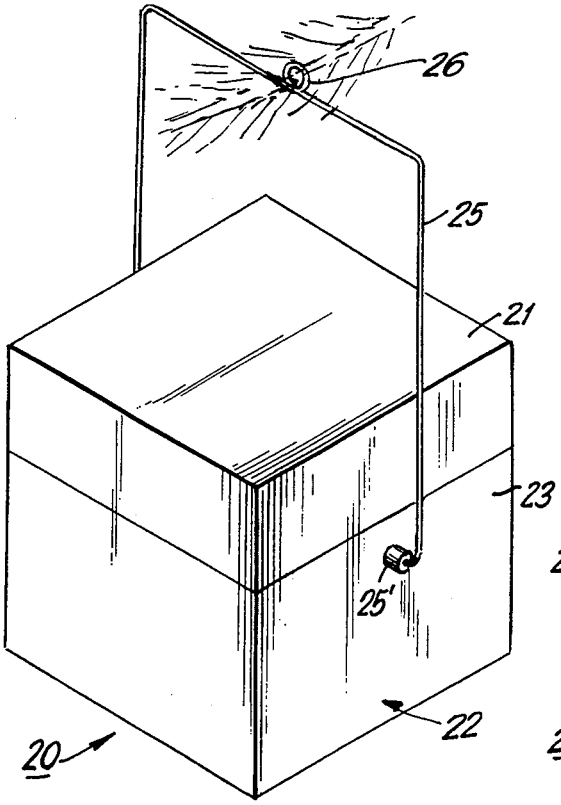
FIG. 1 is a perspective view of a box constructed in accordance with the invention and including a handle/-hanger for securing it to a Christmas tree.

Referring to the drawings, a cube-shaped music box 20 is disclosed, having a top cover 21 covering a bottom container portion 22. The sides 23 of the box are provided with retainer holes 24 to receive the bearings 25' of wire handle 25 (shown only in FIG. 1) formed, in this instance, with a central loop 26 for engaging the branch of a Christmas tree.

Figure 2:
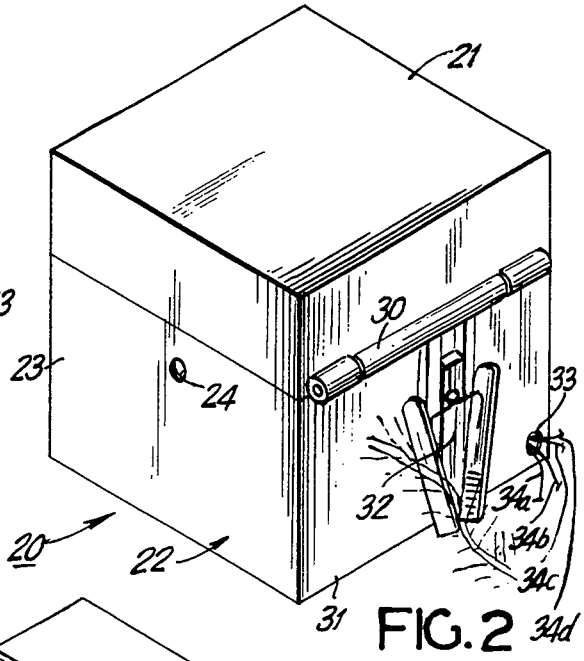
FIG. 2 is a perspective view of the box of FIG. 1 showing the rear side, the handle removed and including a clip for securing it to a Christmas tree.

The top 21 is hinged as at 30 to the bottom 27 along the upper edge of the rear wall 31 of the bottom which, as shown only in FIG. 2, is provided with a clip 32 as an alternate means to engage the branch of a Christmas tree. An aperture 33 in a lower corner of the rear wall provides a channel for electric wires **34*a*, 34*b*, 34*c* and 34*d***.

Figure 3:
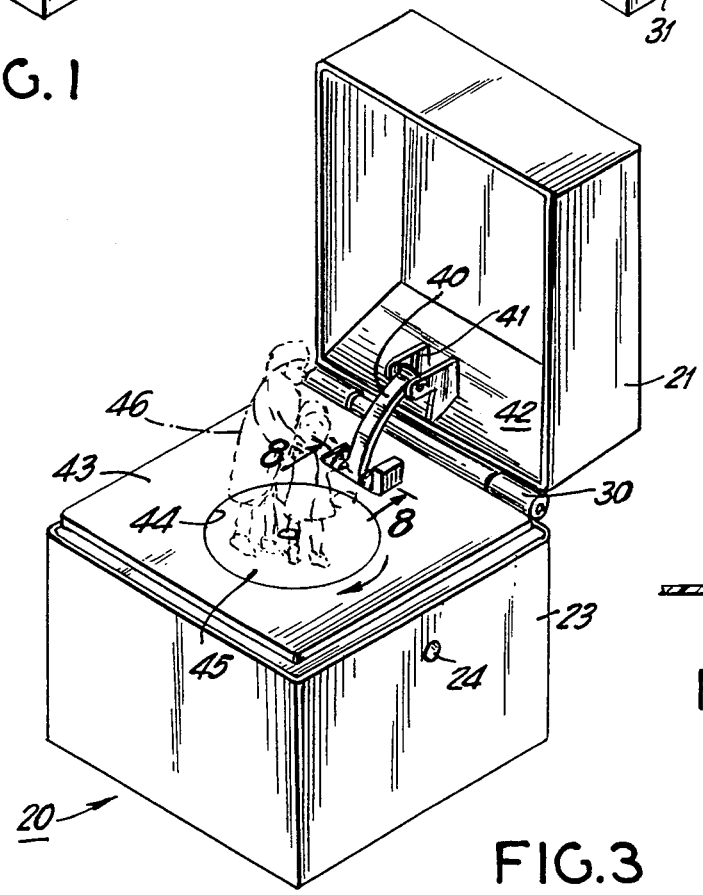
FIG. 3 is a perspective view of the box of FIGS. 1 and 2 shown with the lid opened.

As seen in FIG. 3, the top 21 is lifted about its hinges 30 via push bar 40 journaled at its upper end in bracket 41 secured to the rear wall 42 of top 21. A stage or floor lying along the plane of the upper edge of the bottom, where it is secured, underlies the top when the top is closed and is provided with a round cut-out area 44 filled with a platform 45 which rises from below the floor as the top is lifted. A scene 46, comprised of upstanding three-dimensional figure, is disposed above the platform, about a vertical axis, and revolves with the platform in the direction of the arrow when the platform is in place; i.e., coplanar with the floor.

In FIGS. 4–7, the front, rear and side walls have been removed from the bottom container portion 22 of the box as has the floor 43 and various parts of the operating mechanisms have been partially broken away in the several views so that the operations can be better appreciated.

The base 50 of the box supports motors 51 and 52, pully bearings 53 and 54, posts 55, 56 and 57, gear shaft brackets 58 and 59 and push bar housing 60.

Posts 55–57 secure brackets (not shown) which stabilize the upper ends of shafts 68*s* and 100 as will be made clear.

When motor 51 is energized, its shaft 65 turns worm gear 66 and through sprocket 67, worm 68, sprocket 69 which turns shaft 70*s* and slip clutch 70*c* to turn sprocket 70 to lift rack 71, push bar 40 secured to rack 71 is lifted to pivot top 21 about its hinge 30 through bracket 41 in which the upper end of push bar 40 is journaled.

At the same time, yoke 80 which is secured to the bottom end of rack 71 via connection bar 81, along with switch bar 82 extending from yoke 80, are also lifted effecting the raising of platform 45 supported on shaft 90 for vertical sliding on the shaft with collar 91 on which it may rest or be formed integral with it, and which is raised by yoke 80.

Figure 8:
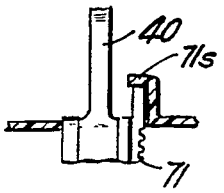
FIG. 8 is a sectional view taken along the line 8—8 of FIG. 3.
Figure 4:
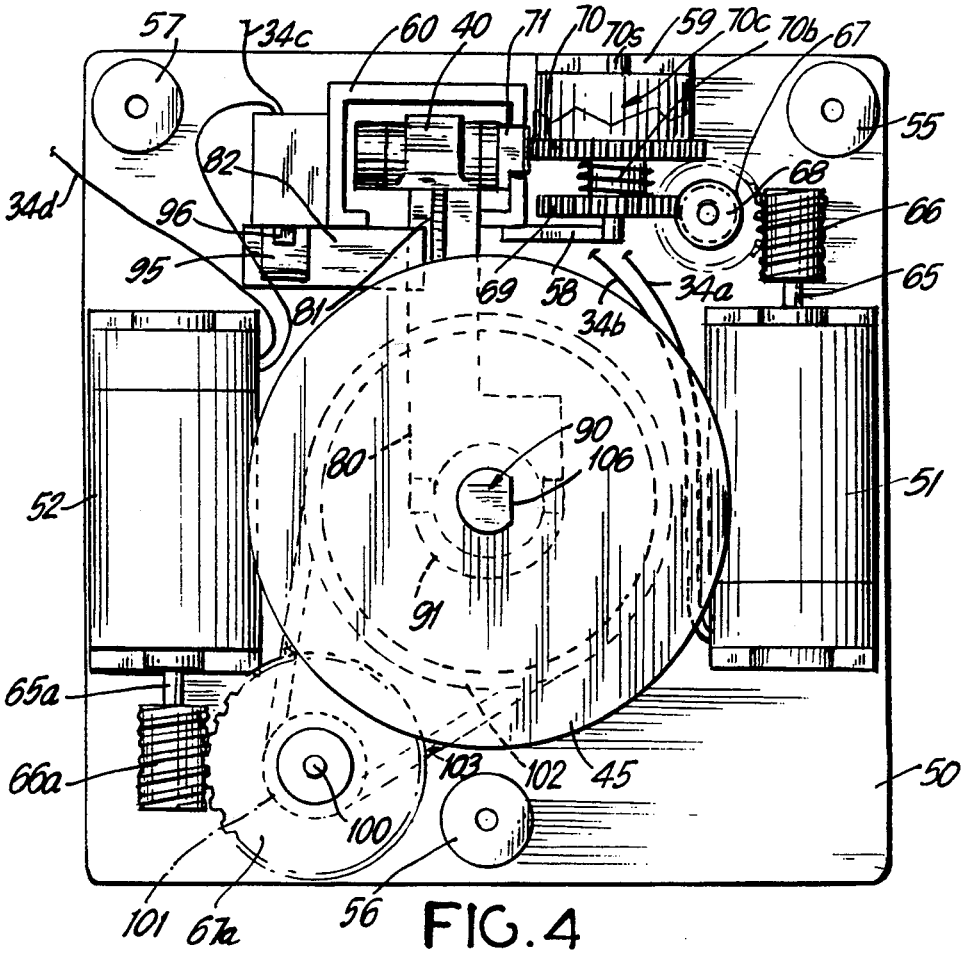
FIG. 4 is a top plan view of the inside of the box of FIGS. 1–3, the lid and side walls having been removed to show the operative elements, partially broken away.
Figure 5:
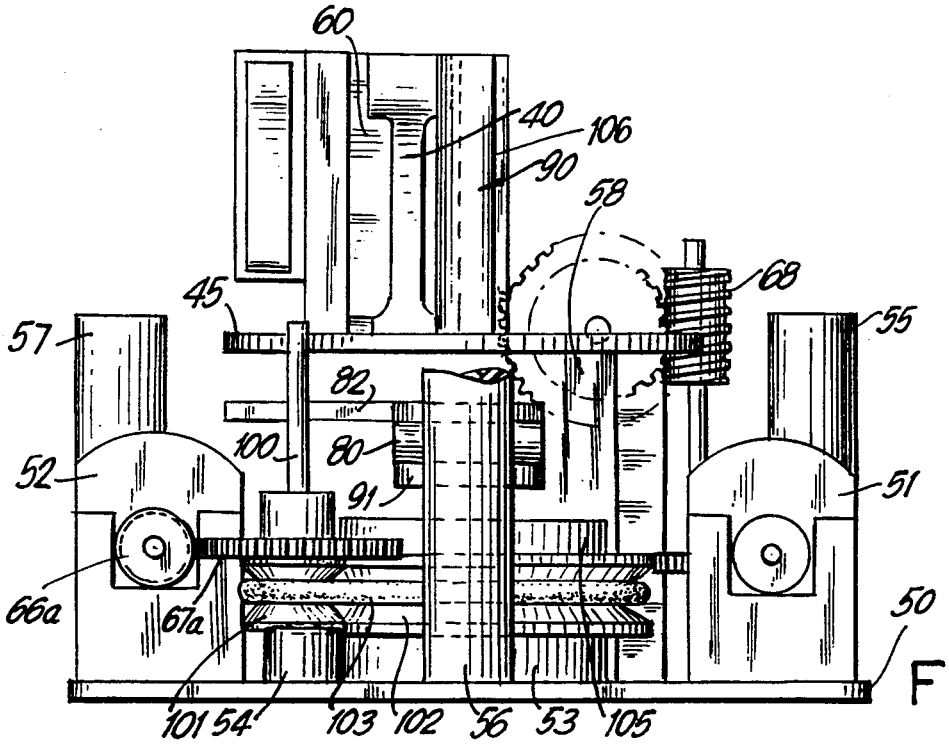
FIG. 5 is a frontal plan view of the inside of the box showing the operative elements, partially broken away.
Figure 6:
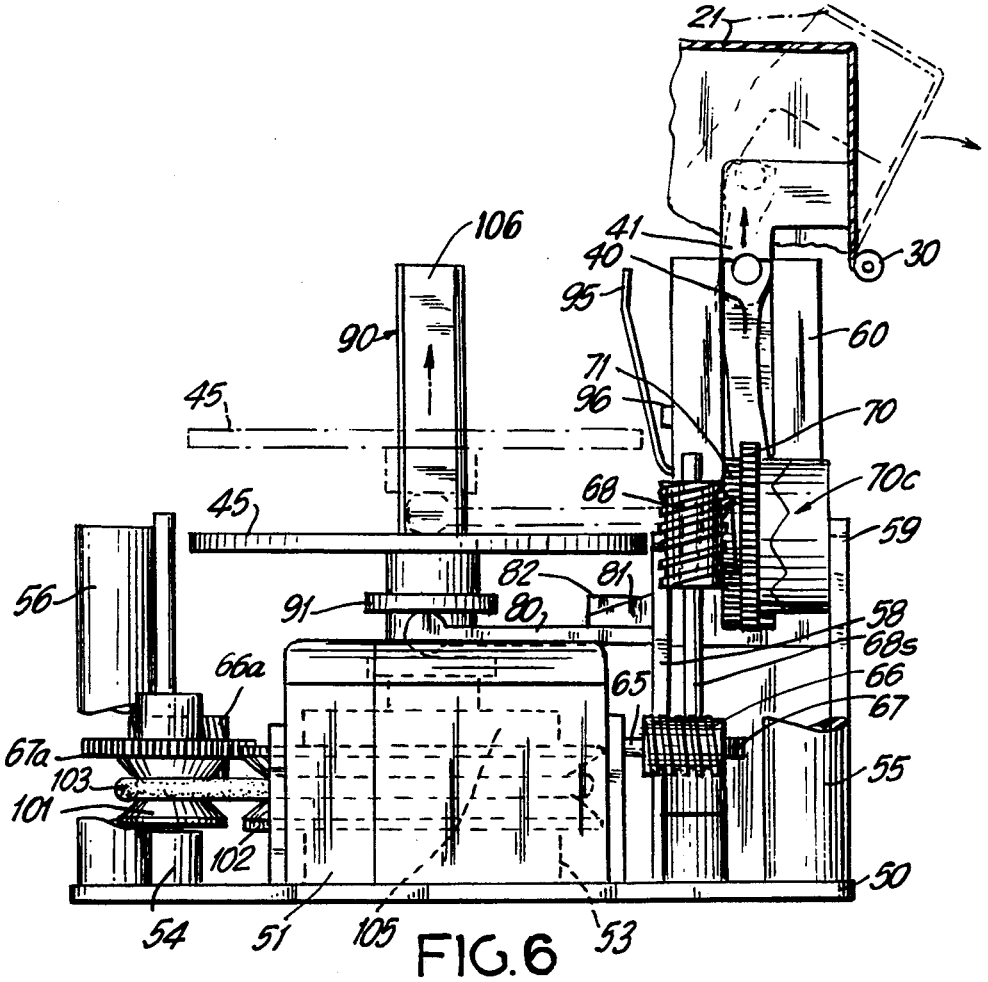
FIG. 6 is a view of the inside of the box taken from the right side to show the operative elements, partially broken away.
Figure 7:
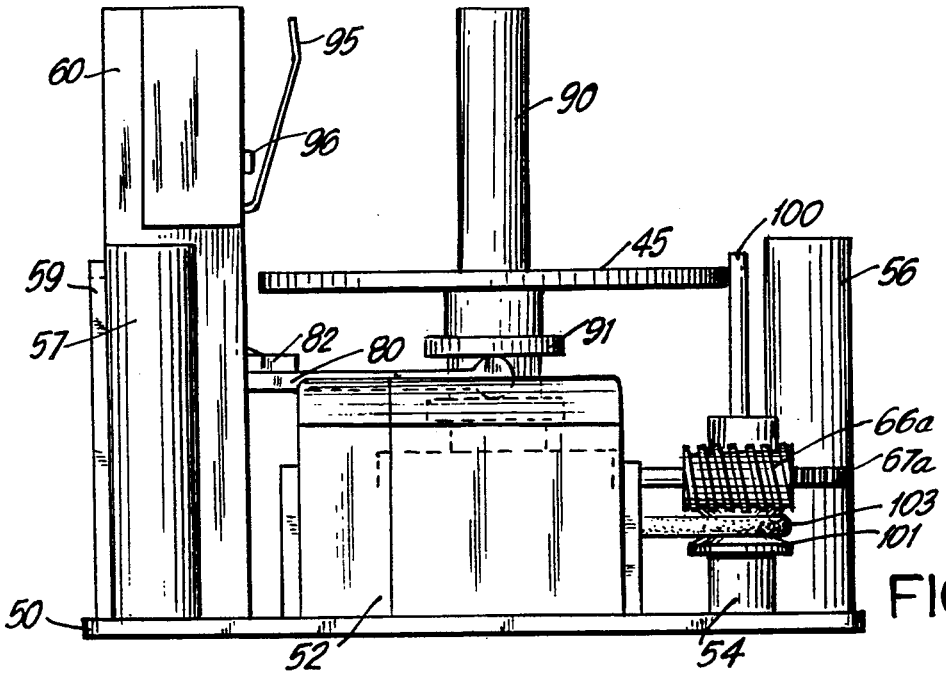
FIG. 7 is a view of the inside of the box taken from the left side.

As the yoke 80 is raised to its uppermost position; i.e., when the platform is coplanar with the floor 43, the switch bar 82 presses against switch spring 95 which depresses button 96 to close a switch which places motor 52 in circuit. Meanwhile, slip clutch 70*c* effects slipping of gear 70 against the bias of spring 70*b* as the upper end of the rack 71 abuts stop 71*s* (FIG. 8) on floor 43.

When motor 52 is energized, power shaft 65*a* turns worm gear 66*a* which in turn causes sprocket gear 67*a* to rotate shaft 100 to which drive pully 101 is secured. Drive pully 101 turns central pully 102 via belt 103. Mounted on central pully for rotation therewith is shaft mounting 105 to which platform shaft 90 is secured.

The shaft 90 is flattened as at 106, so that platform 45 and collar 91, having correspondingly shaped central apertures, will rotate with shaft 90.

Music is supplied from central controller 110 (FIG. 9) during the opening of the top and while the top is in the opened position. The programmed sequence cuts power to motor 52, reverses power polarity to motor 51 which drives the power train of gears in reverse to lower the platform and close the top.

Figure 9:
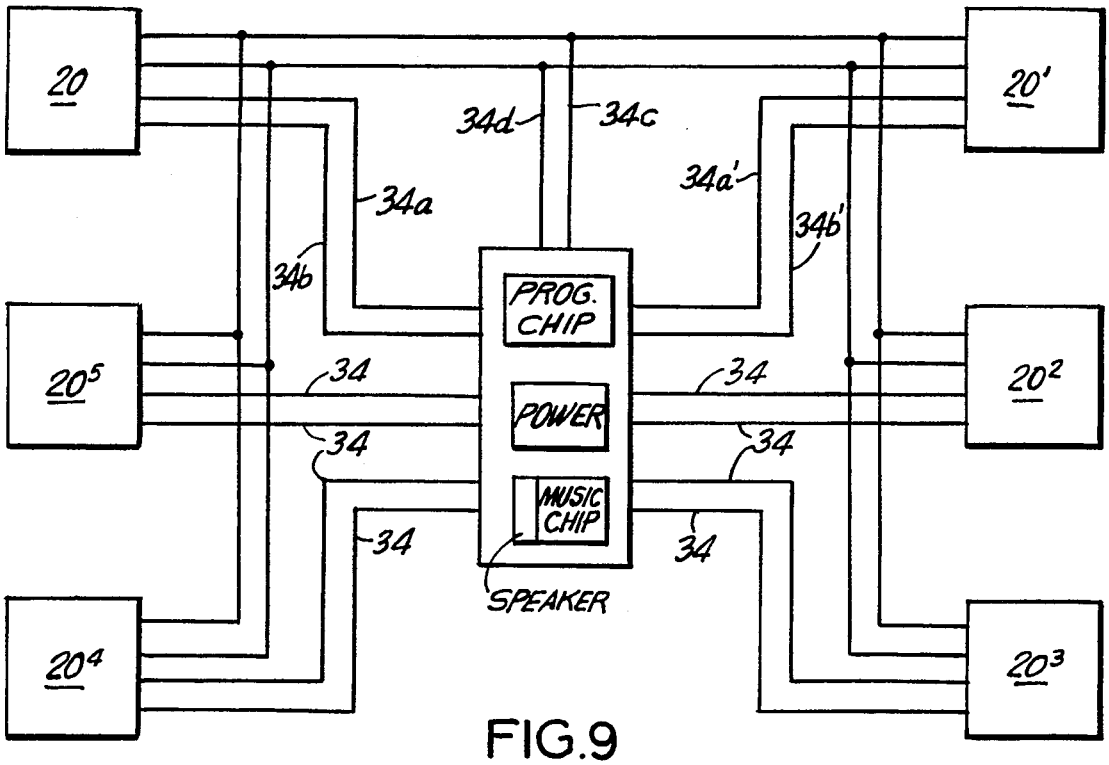
FIG. 9 is a schematic view of the controller and external circuitry to operate a plurality of boxes.

As seen in FIG. 9, the controller has been programmed to energize the motor 51 of box 20 through connectors 34*a* and 34*b* and the motor 52 through connectors 34*b* and 34*c*. When the sequence of operations is completed, the controller switches the power to wires 34*a*′ and 34*b*′ to energize the lifting motor in box $20^1$. Inasmuch as the platform rotating motor in each box is switched off until the switch activated by button 96 is closed, connectors 34*d*, 34*c* are connected in series to each of the boxes 20, $20^1$, $20^2$, $20^3$, $20^4$ and $20^5$.

As will be appreciated, the circuit can be designed in various other models to accomplish the desired lift/rotate objectives of the invention.

Figure 10:
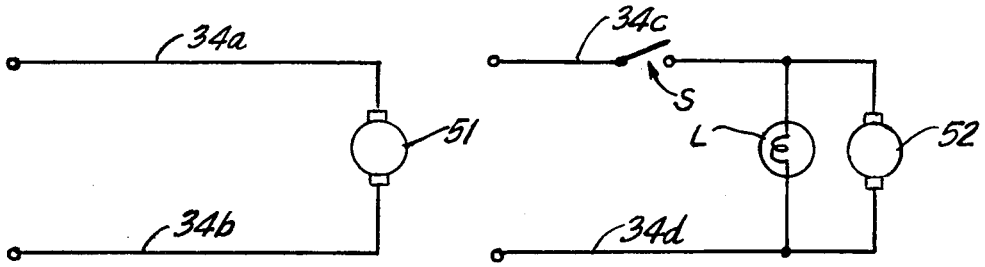
FIG. 10 is a diagram, a one circuit for energizing the box for operation.

In this last respect, FIG. 10 illustrates the wiring as discussed above, including wires 34*a* and 34*b* energizing motor 51 to lift the platform and depress the buttom 96 to close switch S to deliver power to motor 52 through wires 34*c* and 34*d*. In FIG. 10, a lamp L is included in the circuit to illuminate the walls of the bottom of the box, which may be translucent and carry a scene, when the platform is rotated. As previously noted, the polarity of wires 34*a* and 34*b* are reversed to reverse the action of motor 51.

Figure 11:
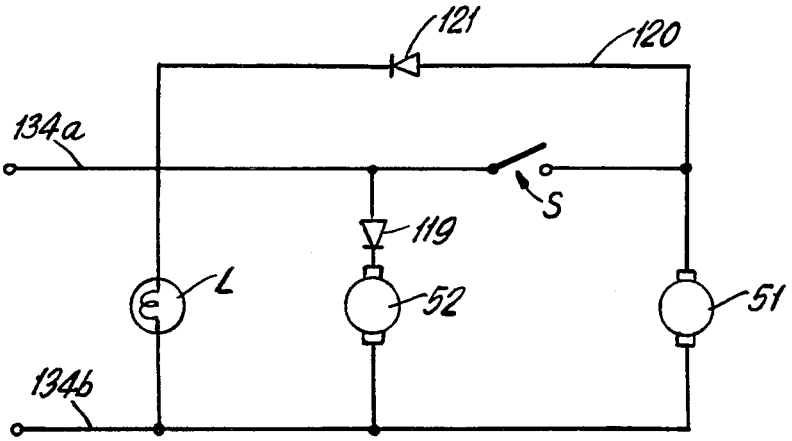
FIG. 11 is a diagram of another circuit for energizing the box for operation.

In FIG. 11, a single set of wires 134*a* and 134*b* energize the circuit to light the lamp and to energize the lift motor 51 when the switch S is closed. The lifting of the platform opens the switch, instead of closing it, to deenergize motor 51. Platform rotating motor is always energized through zener diode 119 in this circuit during the sequential operation of the box. The polarity of the wires is reversed and motor 51 is reversed in bypass circuit 120 through diode 121 and motor 52 is shut down.

Having described an embodiment of the invention, it should be understood that the invention is not to be restricted to the disclosure herein, but rather to the scope of the following claims.

What is claimed is:

1. An ornamental closure comprising a container portion, a cover, means mounting said cover for movement from a closed position covering at least a portion of said container portion to an open position exposing said portion of said container portion, an upstanding three-dimensional scene stored in a first position within said container portion, means mounting said scene for movement from said first position to a second position, exposed for viewing, when said cover is in said open position, means for moving said cover to said open position to open said closure and expose said scene to view, means for moving said scene from said stored first position to said exposed second position and means for animating said scene, said animating means including means for pivoting said scene about a vertical axis.

2. The closure of claim 1 wherein said scene comprises a platform disposed in said container portion in said first position remote from said cover when said cover is in the closed position and said means for moving said cover and said means for moving said scene are parts of a single power train.

3. An ornamental closure comprising a container portion, a cover, means mounting said cover for movement from a closed position covering at least a portion of said container portion to an open position exposing said portion of said container portion, a scene stored in a first position within said container portion, means mounting said scene for movement from said first position to a second position, exposed for viewing when said cover is in said open position, means for moving said cover to said open position to open said closure and expose said scene to view, means for moving said scene from said stored first position to said exposed second position, said scene comprising a platform disposed in said container portion in said first position remote from said cover when said cover is in the closed position and said means for moving said cover and said means for moving said scene are parts of a single power train, said closure further comprising means for animating said scene including means for rotating said platform when said platform is in said second exposed position.

4. The closure of claim 3, including means for playing music during the time said cover is in said open position.

5. The closure of claim 4 wherein said means for moving said scene and said means for moving said cover also comprise means for moving said scene from said second position to said first position and means for moving said cover from said open position to said closed position.

6. The closure of claim 3, including a source of electric power supplying power to a first motor and a second motor to energize the same, first power train means from said first motor to said cover and said scene and constituting, with said first motor, said means for moving said cover and said means for moving said scene, second power train means from said second motor to said scene and constituting, with said second motor, said means for rotating said platform.

7. The closure of claim 6, including means for electronically generating music during the time said cover is in the open position and including controller means for controlling energizing said first and second motors and said music generating means.

8. The closure of claim 7 wherein said means for moving said scene and said means for moving said cover also comprise means for moving said scene from said second position to said first position and means for moving said cover from said open position to said closed position and said closure is part of a system which includes means for operating said closure comprising said controller means for controlling energizing said first and second motors and said music generating means for sequentially opening said closure by moving said cover, raising said scene by lifting said platform, animating said scene by rotating said platform, playing music by energizing said music generating means, lowering said scene by lowering said platform, deenergizing said music generating means and said means for moving said scene, and closing said closure by moving said cover to said closed position.

9. The closure of claim 8 wherein said closure is one of a plurality of like closures in said system, said system including electrical connecting means between said controller means and said plurality of closures, said controller means including means for sequentially operating each closure.

10. The system of claim 9 wherein said music generating means includes a program of a plurality of melodies and means for playing said melodies sequentially and in time with the opening of each of said plurality of closures.

11. The closure of claim 3 wherein said container portion includes a translucent wall, an electric lamp within said container and means for lighting said lamp when said cover is moved to said open position.

12. The closure of claim 11 wherein said translucent wall includes a decorative scene.

13. The closue of claim 3 wherein said container portion includes an electric lamp within said container and means for lighting said lamp when said cover is moved to said open position.

14. The closure of claim 3 wherein said container portion is a cube-shaped box having front, back and side walls, a base floor and a top floor, said top floor lying a predetermined distance above said base floor substantially in a plane with upper edges of said walls and having a central aperture, said cover is a lid shaped to cover said top floor and having front, back and side walls lying, when in the closed position, in planes common with said walls of said container portion, said means mounting said cover comprises hinge means between said back walls of said cover and container portions, a bracket secured to said cover back wall, a push bar journalled in said bracket and extending into said container portion and connected to said means for moving said cover, said scene comprising said platform and three-dimensional figures on said platform, said figures and said platform being sized to extend, when in said stored first position, from below said cover top to below said top floor of said container portion, the horizontal dimensions of said platform being sized to fit within the central aperture of said top floor, said means mounting said scene comprising a shaft, said platform is mounted on said shaft for vertical sliding movement along said shaft, said platform being connected to said means for moving said scene to said exposed second position with said platform extending in said central aperture, said shaft being connected to said means for animating said scene.

15. The closure of claim 14 wherein said platform is mounted on said shaft for rotation with said shaft, said means for animating said scene comprises said means for rotating said platform.

16. The closure of claim 14 wherein said means for moving said scene extends from said means for moving said cover whereby said cover and said scene are moved simultaneously.

* * * * *